United States Patent [19]

Barry et al.

[11] Patent Number: 5,034,073

[45] Date of Patent: Jul. 23, 1991

[54] INSENSITIVE HIGH EXPLOSIVE

[75] Inventors: Jude W. Barry, Carmichael; Ralph M. Moorehead, Shingle Springs, both of Calif.

[73] Assignee: Aerojet General Corporation, Folsom, Calif.

[21] Appl. No.: 595,114

[22] Filed: Oct. 9, 1990

[51] Int. Cl.[5] ..... C06G 45/10

[52] U.S. Cl. ..... 149/19.9; 149/21; 149/36; 149/42; 149/43; 149/45; 149/61; 149/77; 149/92; 149/93; 149/105; 149/109.6; 149/111; 149/114

[58] Field of Search ..... 149/19.9, 21, 36, 42, 149/43, 45, 61, 77, 92, 93, 105, 109.6, 111, 114

[56] References Cited

U.S. PATENT DOCUMENTS

| | | | |
|---|---|---|---|
| 2,325,064 | 7/1943 | Lawrence | 52/11 |
| 2,637,274 | 5/1953 | Taylor | 102/98 |
| 3,212,254 | 10/1965 | Fox | 60/35.4 |
| 3,554,820 | 1/1971 | Evans | 149/19 |
| 3,725,154 | 4/1973 | McCullough | 149/21 |
| 3,865,035 | 2/1975 | Munson | 102/66 |
| 3,880,683 | 4/1975 | Voreck et al. | 149/21 |
| 4,092,188 | 5/1978 | Cohen | 149/19.4 |
| 4,158,583 | 6/1979 | Anderson | 149/19.4 |
| 4,214,928 | 7/1980 | Consaga | 149/19.9 |
| 4,239,073 | 12/1980 | Reed | 149/19.91 |
| 4,289,551 | 9/1981 | Perrault | 149/19.4 |
| 4,343,663 | 8/1982 | Breza et al. | 149/46 |
| 4,366,010 | 12/1982 | Sedat | 149/19.6 |
| 4,394,197 | 7/1983 | Kubik | 149/19.3 |
| 4,421,578 | 12/1983 | Voreck, Jr. | 149/2 |
| 4,981,665 | 1/1991 | Boecker | 423/345 |

FOREIGN PATENT DOCUMENTS

| | | |
|---|---|---|
| 979729 | 8/1962 | United Kingdom . |
| 1203946 | 9/1967 | United Kingdom . |
| 1166405 | 11/1967 | United Kingdom . |
| 1225205 | 3/1969 | United Kingdom . |
| 1297756 | 4/1971 | United Kingdom . |
| 1554636 | 7/1976 | United Kingdom . |
| 2170494 | 10/1988 | United Kingdom . |

*Primary Examiner*—Stephen J. Lechert, Jr.
*Attorney, Agent, or Firm*—Townsend and Townsend

[57] ABSTRACT

An explosive composition having a combination of a principal explosive, which is relatively insensitive to initiation of detonation, two mesh fractions of a sensitizing explosive which is relatively sensitive to initiation of detonation, a critical diameter additive which lowers the critical diameter of the composition, and a binder, demonstrates the ability to achieve steady-state detonation after deliberate initiation of detonation. The composition is further characterized by low sensitivity to accidental detonation by external influences, and favorable mechanical and processability properties.

A method of making an explosive composition of this type by adjusting the amount of critical diameter additive and testing the composition is also described.

36 Claims, No Drawings

INSENSITIVE HIGH EXPLOSIVE

The invention herein described as made in the course of or under contract with the U.S. Air Force ("Development of Insensitive Cure Cast Explosive", contract number F08635-86-C-0334).

BACKGROUND OF THE INVENTION

This invention relates to explosive compositions, particularly to insensitive explosive compositions which exhibit steady-state detonation at reasonable critical diameter.

The unintentional detonation of high energy explosives has been responsible for a number of catastrophes, particularly in military use. The high potential for loss of life and destruction of equipment has prompted the military to impose severe limitations on the means and facilities for transport, handling and storage of such explosives. Military standards have been promulgated for insensitive high explosives (IHE) relating to performance and sensitivity to physical shock, fire, electrostatic discharge, and other hazards.

In view of these concerns, a variety of special formulations drawn to meeting military standards for IHE contracts has been developed, in attempts to combine high performance with low sensitivity to such influences as unintended impacts, electrostatic discharge, friction, and exposure to heat and flames of varying temperatures. The formulations developed to date range from certain types of melt-cast explosives to explosives which are combined with polymeric binders. Of the latter, pour-castable IHE's have been developed. For example, British patent No. 2 170 494, issued to Aerojet General Corporation, discloses an explosive composition which combines high performance with low sensitivity to external influences, yet has favorable mechanical properties and is capable of being poured into molds for casting.

Unfortunately, the usefulness of the melt-cast and pour-castable compositions is limited. The melt-cast compositions are limited by their physical and mechanical properties—i.e., some of the compositions are difficult to form into certain desired shapes, while others are susceptible to cracking under low temperature conditions, or have poor tensile or elongation properties or high modulus. On the other hand, state-of-the-art pour-castable compositions have excellent physical, mechanical and accidental ignition properties, but require cast diameters too large for sustaining detonation once deliberately initiated. Accordingly, the range of application of such compositions is limited, and few are satisfactory for use in general purpose munitions.

SUMMARY OF THE INVENTION

A unique explosive composition has now been discovered, which combines the favorable properties of the pour-castable explosives (high performance, low sensitivity to external influences, good physical and mechanical properties) with the ability to achieve steady-state detonation at cast diameters useful for general purpose munitions. The composition comprises a mixture of high and low initiation sensitivity explosives together with a critical diameter additive, present in sufficient amount to lower the critical diameter of the solid cured composition enough to be useful for achieving steady-state detonation after deliberate detonation in general purpose munitions. The foregoing ingredients are formulated in a fluid binder capable of being cured to solid form.

A novel method of reducing the critical diameter of IHE's by using critical diameter additives is also disclosed.

DESCRIPTION OF SPECIFIC EMBODIMENTS

According to the present invention, a principal explosive, which is relatively insensitive to initiation of detonation, is combined with a sensitizing explosive, which is relatively sensitive to initiation of detonation, a critical diameter additive, and a binder. More specifically, the sensitizing explosive comprises two mesh fractions of a sensitizing explosive, the combination giving the overall composition the desired insensitivity to accidental initiation of detonation. The term "mesh fraction" as used herein refers to separate portions of the sensitizing explosive with specific average particle sizes.

An important feature of the present invention is the insensitivity of the compositions to accidental initiation of detonation. This is achieved by adjusting the ratio of average particle size of the first mesh fraction to second mesh fraction of the sensitizing explosive. Best results will generally be achieved with a particle size ratio ranging from about 50:1 to about 30:1, preferably from about 45:1 to about 35:1. It is particularly preferred that the first mesh fraction of sensitizing explosive have an average particle size ranging from about 140 to about 160 microns, preferably from about 148 to about 152 microns in diameter. The second mesh fraction of sensitizing explosive has an average particle size ranging from about 1 to about 10 microns, preferably from about 2 to about 8 microns in diameter, with an average particle size ranging from about 3 to about 5 microns being particularly preferred.

The weight ratio of first mesh fraction to second mesh fraction of sensitizing explosive ranges from about 1:1 to about 1:30, with weight ratios ranging from about 1:3 to about 1:10 being preferable.

Another important feature of the IHE compositions of the present invention and methods for their preparation is the control of critical diameter. The term "critical diameter" as used herein refers to the minimum diameter of a right cylinder of cast IHE at which detonation will sustain itself—i.e., achieve steady-state detonation. The term "critical diameter additive" as used herein refers to specific average particle size ingredients which function to lower the critical diameter of cast IHE's so that they may be deliberately initiated and used in general purpose munitions.

To adjust the critical diameter of the composition using the critical diameter additive, it is preferred to use an additive with average particle size ranging from about 10 to about 150 microns in diameter, with best results being achieved with an average particle size ranging from about 25 to about 35 microns in diameter.

Within the above-defined groups, a number of specific examples are preferred. Examples of the principal explosive are nitroguanidine, guanidine nitrate, ammonium picrate, 2,4-diamino-1,3,5-trinitrobenzene (DATB), potassium perchlorate, potassium nitrate, and lead nitrate. Particularly preferred principal explosives are nitroguanidine, ammonium picrate, and DATB, the most preferred being nitroguanidine.

Of the sensitizing explosives, preferred examples include cyclo-1,3,5-trimethylene-2,4,6-trinitramine (RDX), cyclotetramethylenetetranitramine (HMX), 2,4,6-trinitrotoluene (TNT), and pentaerythritoltetranitrate (PETN). Particularly preferred among these is RDX.

As indicated previously, an important aspect of the novel compositions is the presence of a critical diameter additive. Although any compound or mixture of compounds which exhibit the ability to adjust the critical diameter without hindering the performance and hazard properties of the IHE may be used, preferred critical diameter additives are selected from the group comprising amine nitrates and amino-nitrobenzenes. Amine nitrates found useful as critical diameter additives include ethylenediamine dinitrate (EDDN) and butylenediamine dinitrate (BDDN). Amino-nitro-benzenes found useful include 1,3,5-triamino-2,4,6-trinitrobenzene (TATB). Particularly preferred is EDDN.

Examples of binder materials useful in the present invention include polybutadienes, both carboxy- and hydroxy-terminated, polyethylene glycol, polyethers, polyesters (particulary hydroxy-terminated), polyfluorocarbons, epoxides, and silicone rubbers (particularly two-part). Preferred binders are those that remain elastomeric in the cured state even at low temperatures such as, for example, down to −100 F. (−73 C.). Accordingly, polybutadienes and two-part silicone rubbers are preferred.

The binders may be curable by any conventional means, including heat, radiation, and catalysts. Heat curable binders are preferred.

As an optional variation, metallic powders such as aluminum may be included in the composition to increase the blast pressure. For best results, the particle size will be 100 mesh or finer, preferably about 2 to about 100 microns. The powder will generally comprise from about 5 percent to about 35 percent by weight of the composition, the higher percentages being required for, among other uses, underwater explosives.

The relative proportions of these components in the composition are as follows, in weight percent of total explosive composition: the principal explosive ranges from about 30 percent to about 60 percent, preferably from about 35 percent to about 55 percent; the first mesh fraction of sensitizing explosive ranges from about 1 percent to about 10 percent, preferably from about 2 percent to about 8 percent; the second mesh fraction of sensitizing explosive ranges from about 10 percent to about 25 percent, preferably from about 15 to about 20 percent; and the critical diameter additive ranges from about 2 to about 20 percent, preferably from about 10 to about 15 percent.

The remainder of the composition is binder or a binder composition, comprised of any liquid or mixture of liquids capable of curing to a solid form, optionally including further ingredients known for use with binders such as, for example, catalysts and stabilizers. The binder is included in sufficient amount to render the uncured composition pourable so that it can be pour-cast. Accordingly, the amount of binder is from about 10 percent to about 20 percent by weight of the total explosive composition, preferably from about 12 percent to about 18 percent.

As is known in the art, to maintain a homogeneous mixture of the explosive components during preparation and casting, it is preferred that principal explosive and sensitizing explosive be of different particle sizes. Best results will generally be achieved with an average particle size ratio of principal explosive to first mesh fraction of sensitizing explosive ranging from about 5:1 to about 20:1, preferably about 10:1. The principal explosive will preferably have an average particle size ranging from about 20 to about 100 microns in diameter.

Variations in the particle sizes and amounts of sensitizing explosive, principal explosive, and critical diameter additive will affect the sensitivity to initiation to detonation, castability, and critical diameter, respectively, of the composition as a whole. Thus the composition may be fine tuned by adjusting these parameters within the ranges stated above.

The compositions of the present invention have an explosive output comparable to such explosives as 2,4,6-trinitrotoluene (TNT), TNT-based aluminized explosives, and Explosive D (ammonium picrate). The performance may be characterized by such parameters as detonation velocity, detonation pressure, and critical diameter.

In a preferred method of practicing the invention, critical diameter tests are performed using fiber optic leads and a dedicated computer. A square steel witness plate is placed on a support of wooden blocks. The cylindrically shaped sample is then secured to the center of the steel plate, and a detonator and booster firmly taped to the top of the sample. Fiber optic leads are embedded in the sample at known distances from the booster. The sample is fired and the detonation rate is read off a dedicated computer. A "go" results when the detonation rate is constant over the length of the sample. If the rate is fading with distance from the booster, or if the sample does not explode at all, it is considered a "no-go." In the preferred practice of the invention, the explosive components are selected to provide the composition with a critical diameter in confined tests of a maximum of about 4.0 inches (10.2 cm), more preferably a maximum of about 2.0 inches (5.08 cm); a detonation velocity of at least about 6.5 kilometers per second, more preferably at least about 7.0 kilometers per second; a detonation pressure of at least about 170 kilobars, more preferably at least about 200 kilobars.

Sensitivity to initiation of detonation of an explosive may be determined and expressed in a wide variety of ways known to those skilled in the art. Most conveniently, this parameter is expressed in terms of the minimum amount or type of booster which when detonated by some means such as, for example, physical impact or electrical shock, will then cause detonation of the main charge explosive. For the principal and sensitizing explosives herein, the sensitivity of each to initiation may be expressed in terms of a lead azide booster. In particular, the principal explosive is characterized as one which is incapable of being initiated by a booster consisting solely of lead azide, but instead requires an additional component of higher explosive output, such as tetryl (trinitrophenylmethylnitramine), to be included as a booster for initiation to occur. Likewise, the sensitizing explosive is characterized as one which is capable of being initiated by a booster consisting of lead azide alone. In preferred embodiments, when a booster consisting of a combination of lead azide and tetryl is used for the principal explosive, at least about 0.10g of tetryl will be required in the combination; and for the sensitizing explosive, less than about 0.5 g of lead azide will be required.

The following examples are offered for illustrative purposes only, and are intended neither to define nor limit the invention in any manner. For both compositions the performance and hazard properties are within the preferred ranges discussed herein, with maximum critical diameter being less than 4 inches, as tested by the fiber optic/dedicated computer system as described.

EXAMPLE 1

| Component | Weight % |
|---|---|
| RDX, 150μ | 3 |
| RDX, 4μ | 19 |
| NQ | 33 |
| EDDN | 15 |
| Al | 14 |
| HTPB binder | 16 |
| | 100 |

EXAMPLE 2

| Component | Weight % |
|---|---|
| RDX, 150μ | 5 |
| RDX, 4μ | 15 |
| NQ | 32 |
| TATB | 10 |
| Al | 20 |
| HTBP binder | 18 |
| | 100 |

Although the foregoing invention has been described in some detail by way of illustration and example for purposes of clarity of understanding, it will be recognized that certain changes and modifications may be practiced within the scope of the appended claims. For example, other suitable critical diameter additives include methylamine nitrate; N,N,N',N'-tetramethylethane-1,2-diamine dinitrate; N,N,N',N'-tetramethylpropane-1,2-diamine dinitrate; diethylene triamine trinitrate; 1,3-diamino-2,4,6-trinitrobenzene, and 1-amino-2,4,6-trinitrobenzene. As stated previously, any compound that can lower the critical diameter without hindering significantly the performance and hazard properties of the IHE may be used.

What is claimed is:

1. An explosive composition comprising:

(A) about 1 to about 10 weight percent of a first mesh fraction of a sensitizing explosive;

(B) about 10 to about 30 weight percent of a second mesh fraction of said sensitizing explosive, the ratio of average particle size of said first mesh fraction to said second mesh fraction being from about 50:1 to about 30:1;

(C) about 30 to about 60 weight percent of a principal explosive selected from the group consisting of nitroguanidine, guanidine dinitrate, ammonium picrate, 2,4-diamino-1,3,5-trinitrobenzene, potassium perchlorate, potassium nitrate, and lead nitrate;

(D) about 2 to about 20 weight percent of a critical diameter additive; and (E) about 10 to about 20 weight percent of a binder, said explosive composition having a maximum unconfined critical diameter of about 4 inches.

2. A composition in accordance with claim 1 having a maximum unconfined critical diameter of about 2 inches.

3. A composition in accordance with claim 1 comprising from about 2 to about 8 weight percent of component (A), from about 15 to about 20 weight percent of component (B), from about 35 to about 55 weight percent of component (C), from about 10 to about 15 weight percent of component (D), and from about 12 to about 18 weight percent of component (E).

4. A composition in accordance with claim 1 where said sensitizing explosive is selected from the group consisting of cyclo-1,3,5-trimethylene-2,4,6-trinitramine, cyclotetramethylenetetranitramine, 2,4,6-trinitrotoluene, and pentaerythritoltetranitrate.

5. A composition in accordance with claim 4 where said sensitizing explosive is cyclo-1,3,5-trimethylene-2,4,6-trinitramine.

6. A composition in accordance with claim 1 where said principal explosive is nitroguanidine.

7. A composition in accordance with claim 1 further comprising from about 5 to about 35 weight percent of powdered aluminum having a particle size ranging from about 2 to about 100 microns in diameter.

8. A composition in accordance with claim 1 where said critical diameter additive is selected from the group comprising amine nitrates and amino-nitro-benzenes.

9. A composition in accordance with claim 8 where said amine nitrate is ethylenediamine dinitrate.

10. A composition in accordance with claim 1 where said sensitizing explosive is cyclo-1,3,5-trimethylene-2,4,6-trinitramine, said principal explosive is nitroguanidine, and said critical diameter additive is ethylenediamine dinitrate with an average particle size ranging from about 10 to about 150 microns in diameter.

11. A composition in accordance with claim 1 where said binder is a hydroxy-terminated polybutadiene binder.

12. A composition in accordance with claim 1 in which the average particle size ratio of component (A) to component (B) ranges from about 50:1 to about 30:1.

13. A composition in accordance with claim 1 in which the average particle size ratio of component (A) to component (B) ranges from about 45:1 to about 35:1, and the weight ratio of component (A) to component (B) ranges from about 1:1 to about 1:30.

14. A composition in accordance with claim 10 where said ethylenediamine dinitrate has an average particle size ranging from about 25 to about 35 microns in diameter.

15. A explosive composition comprising:

(A) about 1 to about 10 weight percent of a first mesh fraction of a sensitizing explosive selected from the group consisting of cyclo-1,3,5-trimethylene-2,4,6-trinitramine, cyclotetramethylenetetranitramine, 2,4,6-trinitrotoluene, and pentaerythritoltetranitrate, having an average particle size of from about 140 to about 160 microns in diameter;

(B) about 10 to 30 weight percent of a second mesh fraction of said sensitizing explosive selected from the group consisting of cyclo-1,3,5-trimethylene-2,4,6-trinitramine, cyclotetramethylenetetranitramine, 2,4,6-trinitrotoluene, and pentaerythritoltetranitrate, having an average particle size of from about 1 to about 10 microns in diameter;

(C) about 30 to 60 weight percent of a principal explosive selected from the group consisting of nitroguanidine, guanidine dinitrate, ammonium picrate, and 2,4-diamino-1,3,5-trinitrobenzene;

(D) about 2 to 20 weight percent ethylenediamine dinitrate having an average particle size of from about 25 to about 35 microns in diameter; and (E) about 10 to about 20 weight percent of a binder, said explosive composition having a maximum unconfined critical diameter of about 4 inches.

16. A composition in accordance with claim 15 having a maximum unconfined critical diameter of about 2 inches.

17. A composition in accordance with claim 15 where said sensitizing explosive is cyclo-1,3,5-trimethylene-2,4,6-trinitramine.

18. A composition in accordance with claim 15 where the average particle size of said first mesh fraction is from about 145 to 155 microns in diameter and the average particle size of said second mesh fraction is from about 2 to about 8 microns in diameter.

19. A composition in accordance with claim 15 where the average particle size of said first mesh fraction is from about 148 to about 152 microns in diameter, the average particle size of said second mesh fraction is from about 3 to about 5 microns in diameter, and weight ratio of said first mesh fraction to said second mesh fraction ranges from about 1:3 to about 1:10.

20. A composition in accordance with claim 15 where said principal explosive is nitroguanidine.

21. A composition in accordance with claim 15 where said sensitizing explosive is cyclo-1,3,5-trimethylene-2,4,6-trinitramine and said principal explosive is nitroguanidine.

22. An explosive composition comprising:

(A) about 1 to about 10 weight percent of a first mesh fraction of a sensitizing explosive consisting of cyclo-1,3,5-trimethylene-2,4,6-trinitramine having an average particle size of from about 140 to about 160 microns in diameter;

(B) about 10 to about 30 weight percent of a second mesh fraction of said sensitizing explosive having an average particle size of from about 1 to about 10 microns in diameter;

(C) about 30 to about 60 weight percent of a principal explosive selected from the group consisting of nitroguanidine, guanidine dinitrate, ammonium picrate, and 2,4-diamino-1,3,5-trinitrobenzene;

(D) about 2 to about 20 weight percent ethylenediamine dinitrate as having an average particle size of from about 25 to about 35 microns in diameter; and (E) about 10 to about 20 weight percent of a hydroxy-terminated polybutadiene binder, said explosive composition having a maximum unconfined critical diameter of about 4 inches.

23. A composition in accordance with claim 22 having a maximum unconfined critical diameter of about 2 inches.

24. A composition in accordance with claim 22 having a first mesh fraction of said sensitizing explosive with a average particle size of from abut 145 to about 155 microns in diameter and a second mesh fraction of said sensitizing explosive having an average particle size of from about 2 to about 8 microns in diameter.

25. A composition according to claim 22 having a first mesh fraction of said sensitizing explosive with an average particle size of from about 148 to about 152 microns in diameter and a second mesh fraction of said sensitizing explosive with an average particle size of from about 3 to about 5 microns in diameter.

26. A composition in accordance with claim 22 where said principal explosive is nitroguanidine.

27. A method of making an insensitive explosive composition having a self-sufficient detonation upon deliberate ignition comprising:

(A) mixing a binder, metallic fuel, a first mesh fraction of a sensitizing explosive, a second mesh fraction of said sensitizing explosive, the ratio of average particle size of said first mesh fraction to said second mesh fraction being from about 50:1 to about 30:1, a principal explosive, and a critical diameter additive to form an insensitive explosive composition having an unconfined critical diameter maximum of 4 inches upon curing; and (B) curing the composition of step (A).

28. A method in accordance with claim 27 where said binder is a hydroxy-terminated polybutadiene binder.

29. A method in accordance with claim 27 where said critical diameter additive is selected from the group comprising ethylenediamine dinitrate, butylenediamine dinitrate, and 1,3,5-triamino-2,4,6-trinitrobenzene having an average particle size ranging from about 25 to about 35 microns in diameter.

30. A method in accordance with claim 29 where said amine nitrate is ethylenediamine dinitrate.

31. A method in accordance with claim 27 where said metallic fuel is aluminum.

32. A method in accordance with claim 27 where said principal explosive is selected from the group consisting of nitroguanidine, guanidine dinitrate, ammonium picrate, and 2,4-diamino-1,3,5-trinitrobenzene.

33. A method in accordance with claim 27 where said sensitizing explosive is selected from the group consisting of cyclo-1,3,5-trimethylene-2,4,6-trinitramine, cyclotetramethylenetetranitramine, 2,4,6-trinitrotoluene, and pentaerythritoltetranitrate.

34. A method in accordance with claim 32 where said principal explosive is nitroguanidine.

35. A method in accordance with claim 33 where said sensitizing explosive is cyclotetramethylenetri-nitramine.

36. A method in accordance with claim 27 which further comprises measuring the unconfined critical diameter of a sample of the composition from step (B) using a dedicated computer.

* * * * *